US010907874B2

(12) United States Patent
Aranda et al.

(10) Patent No.: US 10,907,874 B2
(45) Date of Patent: Feb. 2, 2021

(54) ICE MAKER DOWNSPOUT

(71) Applicant: WHIRLPOOL CORPORATION, Benton Harbor, MI (US)

(72) Inventors: Jose R. Aranda, Stevensville, MI (US); Erdogan Ergican, St. Joseph, MI (US); Sann M. Naing, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 67 days.

(21) Appl. No.: 16/167,076

(22) Filed: Oct. 22, 2018

(65) Prior Publication Data

US 2020/0124333 A1 Apr. 23, 2020

(51) Int. Cl.

| | |
|---|---|
| ***F25C 1/25*** | (2018.01) |
| ***F15D 1/00*** | (2006.01) |
| ***F15D 1/06*** | (2006.01) |

(52) U.S. Cl.

CPC ..... *F25C 1/25* (2018.01); *F15D 1/001* (2013.01); *F15D 1/06* (2013.01); *F25C 2400/10* (2013.01)

(58) Field of Classification Search

CPC ..... F25C 1/25; F25C 2400/10; F15D 1/001; F15D 1/06

USPC ..... 138/39

See application file for complete search history.

(56) References Cited

U.S. PATENT DOCUMENTS

| | | | |
|---|---|---|---|
| 275,192 | A | 4/1883 | Goodell |
| 286,604 | A | 10/1883 | Goodell |
| 301,539 | A | 7/1884 | Vezin |
| 1,407,614 | A | 2/1922 | Wicks |
| 1,616,492 | A | 2/1927 | Lado |
| 1,889,481 | A | 11/1932 | Kennedy, Jr. |
| 1,932,731 | A | 10/1933 | Hathorne |
| 2,027,754 | A | 1/1936 | Smith |
| 2,244,081 | A | 3/1938 | Reeves |
| 2,617,269 | A | 6/1949 | Smith-Johannsen |
| 2,481,525 | A | 9/1949 | Mott |
| 2,757,519 | A | 2/1954 | Sampson |
| 2,846,854 | A | 2/1954 | Galin |
| 2,683,356 | A | 7/1954 | Green, Jr. |
| 2,878,659 | A | 7/1955 | Prance et al. |
| 2,942,432 | A | 6/1960 | Muffly |

(Continued)

FOREIGN PATENT DOCUMENTS

| | | | |
|---|---|---|---|
| AU | 2006201786 | A1 | 11/2007 |
| CN | 1989379 | A | 6/2007 |

(Continued)

OTHER PUBLICATIONS

Merriam-Webster definition of oscillate, http://www.Merriam-Webster.com/dictionary/oscillate, pp. 1-4, accessed from Internet Aug. 6, 2015.

(Continued)

*Primary Examiner* — Craig M Schneider
*Assistant Examiner* — David R Deal
(74) *Attorney, Agent, or Firm* — Price Heneveld LLP

(57) ABSTRACT

A downspout for delivering water to an ice tray in a refrigerated appliance includes a cavity defined by at least one flute and at least one lobe. The downspout includes an inlet port for receiving water. The at least one flute and at least one lobe are configured to create a substantially laminar flow of the water received from the inlet port along the at least one flute and the at least one lobe.

15 Claims, 11 Drawing Sheets

(56) References Cited

U.S. PATENT DOCUMENTS 2,969,654 A 1/1961 Harle
2,996,895 A 8/1961 Lippincott
3,009,336 A 11/1961 Bayston et al.
3,016,719 A 1/1962 Reindl
3,033,008 A 5/1962 Davis
3,046,753 A 7/1962 Carapico, Jr.
3,071,933 A 1/1963 Shoemaker
3,075,360 A 1/1963 Elfving et al.
3,075,364 A 1/1963 Kniffin
3,084,678 A 4/1963 Lindsay
3,084,878 A 4/1963 Helming et al.
3,093,980 A 6/1963 Frei
3,144,755 A 8/1964 Kattis
3,159,985 A 12/1964 Keighley
3,172,269 A 3/1965 Cole
3,192,726 A 7/1965 Newton
3,200,600 A 8/1965 Elfving
3,214,128 A 10/1965 Beck et al.
3,217,508 A 11/1965 Beck et al.
3,217,510 A 11/1965 Kniffin et al.
3,217,511 A 11/1965 Keighley
3,222,902 A 12/1965 Brejcha et al.
3,228,222 A 1/1966 Maier
3,255,603 A 6/1966 Johnson et al.
3,306,064 A 2/1967 Poolos
3,308,631 A 3/1967 Kniffin
3,318,105 A 5/1967 Burroughs et al.
3,321,932 A 5/1967 Orphey, Jr.
3,383,876 A 5/1968 Frohbieter
3,412,572 A 11/1968 Kesling
3,426,564 A 2/1969 Jansen et al.
3,451,237 A 6/1969 Baringer et al.
3,596,477 A 8/1971 Harley
3,632,049 A 1/1972 Winters
3,638,451 A 2/1972 Brandt
3,646,792 A 3/1972 Hertel et al.
3,648,964 A 3/1972 Fox
3,677,030 A 7/1972 Nicholas
3,684,235 A 8/1972 Schupbach
3,720,235 A * 3/1973 Schrock ..... F16L 11/121 138/137
3,775,992 A 12/1973 Bright
3,788,089 A 1/1974 Graves
3,806,077 A 4/1974 Pietrzak et al.
3,864,933 A 2/1975 Bright
3,892,105 A 7/1975 Bernard
3,908,395 A 9/1975 Hobbs
3,952,539 A 4/1976 Hanson et al.
4,006,605 A 2/1977 Dickson et al.
D244,275 S 5/1977 Gurbin
4,024,744 A 5/1977 Trakhtenberg et al.
4,059,970 A 11/1977 Loeb
4,062,201 A 12/1977 Schumacher et al.
4,078,450 A 3/1978 Vallejos
D249,269 S 9/1978 Pitts
4,142,378 A 3/1979 Bright et al.
4,148,457 A 4/1979 Gurbin
4,184,339 A 1/1980 Wessa
4,222,547 A 9/1980 Lalonde
4,261,182 A 4/1981 Elliott
4,288,497 A 9/1981 Tanaka et al.
4,402,185 A 9/1983 Perchak
4,402,194 A 9/1983 Kuwako et al.
4,412,429 A 11/1983 Kohl
4,462,345 A 7/1984 Routery
4,483,153 A 11/1984 Wallace
4,487,024 A 12/1984 Fletcher et al.
4,550,575 A 11/1985 DeGaynor
4,562,991 A 1/1986 Wu
4,587,810 A 5/1986 Fletcher
4,627,946 A 12/1986 Crabtree
4,628,699 A 12/1986 Mawby et al.
4,669,271 A 6/1987 Noel
4,680,943 A 7/1987 Mawby et al.
4,685,304 A 8/1987 Essig
4,688,386 A 8/1987 Lane et al.
4,727,720 A 3/1988 Wernicki
4,843,827 A 7/1989 Peppers
4,852,359 A 8/1989 Manzotti
4,856,463 A 8/1989 Johnston
4,872,317 A 10/1989 Reed
4,910,974 A 3/1990 Hara
4,942,742 A 7/1990 Burruel
4,970,877 A 11/1990 Dimijian
4,971,737 A 11/1990 Infanti
5,025,756 A 6/1991 Nyc
D318,281 S 7/1991 McKinlay
5,044,600 A 9/1991 Shannon
5,129,237 A 7/1992 Day et al.
5,157,929 A 10/1992 Hotaling
5,177,980 A 1/1993 Kawamoto et al.
5,196,127 A 3/1993 Solell
5,253,487 A 10/1993 Oike
5,257,601 A 11/1993 Coffin
5,272,888 A 12/1993 Fisher et al.
5,358,007 A * 10/1994 Carlberg ..... E03F 1/002 137/561 A
5,372,492 A 12/1994 Yamauchi
5,378,521 A 1/1995 Ogawa et al.
5,400,605 A 3/1995 Jeong
5,408,844 A 4/1995 Stokes
5,425,243 A 6/1995 Sanuki et al.
5,483,929 A 1/1996 Kuhn et al.
5,586,439 A 12/1996 Schlosser et al.
5,617,728 A 4/1997 Kim et al.
5,632,936 A 5/1997 Su et al.
5,618,463 A 8/1997 Rindler et al.
5,675,975 A 10/1997 Lee
5,761,920 A 6/1998 Wilson et al.
5,768,900 A 6/1998 Lee
5,826,320 A 10/1998 Rathke et al.
5,884,487 A 3/1999 Davis et al.
5,884,490 A 3/1999 Whidden
D415,505 S 10/1999 Myers
5,970,725 A 10/1999 Lee
5,970,735 A 10/1999 Hobelsberger
5,992,465 A * 11/1999 Jansen ..... F16L 55/00 138/37
6,058,720 A 5/2000 Ryu
6,062,036 A 5/2000 Hobelsberger
6,082,130 A 7/2000 Pastryk et al.
6,101,817 A 8/2000 Watt
6,145,320 A 11/2000 Kim
6,148,620 A 11/2000 Kumagai et al.
6,148,621 A 11/2000 Byczynski et al.
6,161,390 A 12/2000 Kim
6,179,045 B1 1/2001 Lilleaas
6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,401,757 B1 * 6/2002 Pentz ..... B05B 7/1486 138/37
6,422,306 B1 * 7/2002 Tomlinson ..... F28D 1/035 165/170
6,425,259 B2 7/2002 Nelson et al.
6,427,463 B1 8/2002 James
6,438,988 B1 8/2002 Paskey
6,467,146 B1 10/2002 Herman
6,481,235 B2 11/2002 Kwon
6,488,463 B1 12/2002 Harris
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Willamor et al.
6,820,433 B2 11/2004 Hwang
6,823,689 B2 11/2004 Kim et al.
6,857,277 B2 2/2005 Somura
6,935,124 B2 8/2005 Takahashi et al.

(56) References Cited

U.S. PATENT DOCUMENTS 6,951,113 B1 10/2005 Adamski
D513,019 S 12/2005 Lion et al.
7,010,934 B2 3/2006 Choi et al.
7,010,937 B2 3/2006 Wilkinson et al.
7,013,654 B2 3/2006 Tremblay et al.
7,051,541 B2 5/2006 Chung et al.
7,059,140 B2 6/2006 Zevlakis
7,062,925 B2 6/2006 Tsuchikawa et al.
7,062,936 B2 6/2006 Rand et al.
7,082,782 B2 8/2006 Schlosser et al.
7,131,280 B2 11/2006 Voglewede et al.
7,185,508 B2 3/2007 Voglewede et al.
7,188,479 B2 3/2007 Anselmino et al.
7,201,014 B2 4/2007 Hornung
7,204,092 B2 4/2007 Castellón et al.
7,210,298 B2 5/2007 Lin
7,216,490 B2 5/2007 Joshi
7,216,491 B2 5/2007 Cole et al.
7,234,423 B2 6/2007 Lindsay
7,266,973 B2 9/2007 Anderson et al.
7,297,516 B2 11/2007 Chapman et al.
7,318,323 B2 1/2008 Tatsui et al.
7,386,993 B2 6/2008 Castellón et al.
D574,932 S * 8/2008 Zhuang ..... B67D 1/0006 D23/266
7,415,833 B2 8/2008 Leaver et al.
7,448,863 B2 11/2008 Yang
7,464,565 B2 12/2008 Fu
7,469,553 B2 12/2008 Wu et al.
7,487,645 B2 2/2009 Sasaki et al.
7,568,359 B2 8/2009 Wetekamp et al.
7,587,905 B2 9/2009 Kopf
7,614,244 B2 11/2009 Venkatakrishnan et al.
7,669,435 B2 3/2010 Joshi
7,681,406 B2 3/2010 Cushman et al.
7,703,292 B2 4/2010 Cook et al.
7,707,847 B2 5/2010 Davis et al.
7,744,173 B2 6/2010 Maglinger et al.
7,752,859 B2 7/2010 Lee et al.
7,762,092 B2 7/2010 Tikhonov et al.
7,770,985 B2 8/2010 Davis et al.
7,802,457 B2 9/2010 Golovashchenko et al.
7,815,079 B2 * 10/2010 Saveliev ..... B67D 1/0006 141/392
7,832,227 B2 11/2010 Wu et al.
7,866,167 B2 1/2011 Kopf
7,870,755 B2 1/2011 Hsu et al.
7,918,105 B2 4/2011 Kim
7,963,120 B2 6/2011 An et al.
8,015,849 B2 9/2011 Jones et al.
8,037,697 B2 10/2011 LeClear et al.
8,074,464 B2 12/2011 Venkatakrishnan et al.
8,099,989 B2 1/2012 Bradley et al.
8,104,304 B2 1/2012 Kang et al.
8,117,863 B2 2/2012 Van Meter et al.
8,171,744 B2 5/2012 Watson et al.
8,196,427 B2 6/2012 Bae et al.
8,281,613 B2 10/2012 An et al.
8,322,148 B2 12/2012 Kim et al.
8,336,327 B2 12/2012 Cole et al.
8,371,133 B2 2/2013 Kim et al.
8,371,136 B2 2/2013 Venkatakrishnan et al.
8,375,739 B2 2/2013 Kim et al.
8,375,919 B2 2/2013 Cook et al.
8,408,023 B2 4/2013 Shin et al.
8,413,619 B2 4/2013 Cleeves
8,424,334 B2 4/2013 Kang et al.
8,429,926 B2 4/2013 Shaha et al.
8,438,869 B2 5/2013 Kim et al.
8,474,279 B2 7/2013 Besore et al.
8,484,987 B2 7/2013 Ducharme et al.
8,516,835 B2 8/2013 Holter
8,516,846 B2 8/2013 Lee et al.
8,555,658 B2 10/2013 Kim et al.
8,616,018 B2 12/2013 Jeong et al.
8,646,283 B2 2/2014 Kuratani et al.
8,677,774 B2 3/2014 Yamaguchi et al.
8,677,776 B2 3/2014 Kim et al.
8,707,726 B2 4/2014 Lim et al.
8,746,204 B2 6/2014 Hofbauer
8,756,952 B2 6/2014 Adamski et al.
8,769,981 B2 7/2014 Hong et al.
8,820,108 B2 9/2014 Oh et al.
8,893,523 B2 11/2014 Talegaonkar et al.
8,925,335 B2 1/2015 Gooden et al.
8,943,852 B2 2/2015 Lee et al.
9,010,145 B2 4/2015 Lim et al.
9,021,828 B2 5/2015 Vitan et al.
9,068,499 B2 * 6/2015 Thayer ..... F02B 37/00
9,127,873 B2 9/2015 Tarr et al.
9,140,472 B2 9/2015 Shin et al.
9,151,415 B2 * 10/2015 Zazovsky ..... F16L 9/00
9,175,896 B2 11/2015 Choi
9,217,595 B2 12/2015 Kim et al.
9,217,596 B2 12/2015 Hall
9,228,769 B2 1/2016 Kim et al.
9,476,631 B2 10/2016 Park et al.
9,557,087 B2 1/2017 Boarman et al.
9,610,836 B2 * 4/2017 Szymusiak ..... B60K 15/035
9,829,235 B2 11/2017 Visin
9,879,896 B2 1/2018 Koo
2002/0014087 A1 2/2002 Kwon
2003/0111028 A1 6/2003 Hallenstvedt
2004/0099004 A1 5/2004 Somura
2004/0144100 A1 7/2004 Hwang
2004/0206250 A1 10/2004 Kondou et al.
2004/0237566 A1 12/2004 Hwang
2004/0261427 A1 12/2004 Tsuchikawa et al.
2005/0067406 A1 3/2005 Rajarajan et al.
2005/0126185 A1 6/2005 Joshi
2005/0126202 A1 6/2005 Shoukyuu et al.
2005/0151050 A1 7/2005 Godfrey
2005/0160741 A1 7/2005 Park
2005/0160757 A1 7/2005 Choi et al.
2006/0005892 A1 * 1/2006 Kuo ..... F15D 1/02 138/37
2006/0016209 A1 1/2006 Cole et al.
2006/0032262 A1 2/2006 Seo et al.
2006/0053805 A1 3/2006 Flinner et al.
2006/0086107 A1 4/2006 Voglewede et al.
2006/0086134 A1 4/2006 Voglewede et al.
2006/0150645 A1 7/2006 Leaver
2006/0168983 A1 8/2006 Tatsui et al.
2006/0207282 A1 9/2006 Visin
2006/0225457 A1 10/2006 Hallin
2006/0233925 A1 10/2006 Kawamura
2006/0242971 A1 11/2006 Cole et al.
2006/0288726 A1 12/2006 Mori et al.
2007/0028866 A1 2/2007 Lindsay
2007/0107447 A1 5/2007 Langlotz
2007/0119202 A1 5/2007 Kadowaki et al.
2007/0130983 A1 6/2007 Broadbent et al.
2007/0137241 A1 6/2007 Lee et al.
2007/0193278 A1 8/2007 Polacek et al.
2007/0227162 A1 10/2007 Wang
2007/0227164 A1 10/2007 Ito et al.
2007/0262230 A1 11/2007 McDermott
2008/0034780 A1 2/2008 Lim et al.
2008/0104991 A1 5/2008 Hoehne et al.
2008/0145631 A1 6/2008 Bhate et al.
2008/0236187 A1 10/2008 Kim
2008/0264082 A1 10/2008 Tikhonov et al.
2008/0289355 A1 11/2008 Kang et al.
2009/0049858 A1 2/2009 Lee et al.
2009/0120306 A1 5/2009 DeCarlo et al.
2009/0165492 A1 7/2009 Wilson et al.
2009/0173089 A1 7/2009 LeClear et al.
2009/0178428 A1 7/2009 Cho et al.
2009/0178430 A1 7/2009 Jendrusch et al.
2009/0187280 A1 7/2009 Hsu et al.
2009/0199569 A1 8/2009 Petrenko
2009/0211266 A1 8/2009 Kim et al.
2009/0211271 A1 8/2009 Kim et al.
2009/0223230 A1 9/2009 Kim et al.

(56) References Cited

U.S. PATENT DOCUMENTS

| | | | |
|---|---|---|---|
| 2009/0235674 | A1 | 9/2009 | Kern et al. |
| 2009/0272259 | A1 | 11/2009 | Cook et al. |
| 2009/0308085 | A1 | 12/2009 | DeVos |
| 2010/0011827 | A1 | 1/2010 | Stoeger et al. |
| 2010/0018226 | A1 | 1/2010 | Kim et al. |
| 2010/0031675 | A1 | 2/2010 | Kim et al. |
| 2010/0043455 | A1 | 2/2010 | Kuehl et al. |
| 2010/0050663 | A1 | 3/2010 | Venkatakrishnan et al. |
| 2010/0050680 | A1 | 3/2010 | Venkatakrishnan et al. |
| 2010/0055223 | A1 | 3/2010 | Kondou et al. |
| 2010/0095692 | A1 | 4/2010 | Jendrusch et al. |
| 2010/0101254 | A1 | 4/2010 | Besore et al. |
| 2010/0126185 | A1 | 5/2010 | Cho et al. |
| 2010/0139295 | A1 | 6/2010 | Zuccolo et al. |
| 2010/0163707 | A1 | 7/2010 | Kim |
| 2010/0180608 | A1 | 7/2010 | Shaha et al. |
| 2010/0197849 | A1 | 8/2010 | Momose et al. |
| 2010/0218518 | A1 | 9/2010 | Ducharme et al. |
| 2010/0218540 | A1 | 9/2010 | McCollough et al. |
| 2010/0218542 | A1 | 9/2010 | McCollough et al. |
| 2010/0251730 | A1 | 10/2010 | Whillock, Sr. |
| 2010/0257888 | A1 | 10/2010 | Kang et al. |
| 2010/0293969 | A1 | 11/2010 | Braithwaite et al. |
| 2010/0313594 | A1 | 12/2010 | Lee et al. |
| 2010/0319367 | A1 | 12/2010 | Kim et al. |
| 2010/0326093 | A1 | 12/2010 | Watson et al. |
| 2011/0005263 | A1 | 1/2011 | Yamaguchi et al. |
| 2011/0023502 | A1 | 2/2011 | Ito et al. |
| 2011/0062308 | A1 | 3/2011 | Hammond et al. |
| 2011/0113810 | A1 | 5/2011 | Mitchell et al. |
| 2011/0146312 | A1 | 6/2011 | Hong et al. |
| 2011/0192175 | A1 | 8/2011 | Kuratani et al. |
| 2011/0214447 | A1 | 9/2011 | Bortoletto et al. |
| 2011/0239686 | A1 | 10/2011 | Zhang et al. |
| 2011/0265498 | A1 | 11/2011 | Hall |
| 2012/0007264 | A1 | 1/2012 | Kondou et al. |
| 2012/0011868 | A1 | 1/2012 | Kim et al. |
| 2012/0023996 | A1 | 2/2012 | Herrera et al. |
| 2012/0047918 | A1 | 3/2012 | Herrera et al. |
| 2012/0073538 | A1 | 3/2012 | Hofbauer |
| 2012/0085302 | A1 | 4/2012 | Cleeves |
| 2012/0174613 | A1 | 7/2012 | Park et al. |
| 2012/0240613 | A1 | 9/2012 | Saito et al. |
| 2012/0291473 | A1 | 11/2012 | Krause et al. |
| 2014/0165601 | A1* | 6/2014 | Boarman ..... F25C 5/182 62/3.3 |
| 2014/0318657 | A1* | 10/2014 | Bixler ..... F15D 1/003 138/39 |
| 2015/0330678 | A1 | 11/2015 | Hu |
| 2016/0370078 | A1 | 12/2016 | Koo |
| 2017/0051966 | A1 | 2/2017 | Powell |
| 2017/0074527 | A1 | 3/2017 | Visin |
| 2017/0191722 | A1 | 7/2017 | Bertolini et al. |
| 2017/0241694 | A1 | 8/2017 | Ji et al. |
| 2017/0292748 | A1 | 10/2017 | Gullett |
| 2017/0307275 | A1 | 10/2017 | McCollough et al. |
| 2017/0307281 | A1 | 10/2017 | Morgan et al. |
| 2017/0314841 | A1 | 11/2017 | Koo et al. |
| 2017/0343275 | A1 | 11/2017 | Kim |
| 2018/0017306 | A1 | 1/2018 | Miller |
| 2018/0017309 | A1 | 1/2018 | Miller et al. |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1710520 | A2 | 11/2006 |
| EP | 1821051 | A1 | 8/2007 |
| EP | 2078907 | A2 | 7/2009 |
| EP | 2375200 | | 10/2011 |
| EP | 2444761 | A2 | 4/2012 |
| EP | 2660541 | | 11/2013 |
| EP | 2743606 | A2 | 6/2014 |
| EP | 2743608 | A2 | 6/2014 |
| FR | 2771159 | A1 | 5/1999 |
| GB | 657353 | A | 9/1951 |
| GB | 2139337 | A | 11/1984 |
| JP | S489460 | | 2/1973 |
| JP | S5278848 | | 6/1977 |
| JP | S60141239 | A | 7/1985 |
| JP | S6171877 | U | 5/1986 |
| JP | 6435375 | | 3/1989 |
| JP | H01196478 | A | 8/1989 |
| JP | H01210778 | A | 8/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2002139268 | A | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2006022980 | A | 1/2006 |
| JP | 2006071247 | A | 3/2006 |
| JP | 2006323704 | A | 11/2006 |
| JP | 2007232336 | A | 9/2007 |
| JP | 4333202 | B2 | 9/2009 |
| KR | 20010109256 | A | 12/2001 |
| KR | 20060013721 | A | 2/2006 |
| KR | 20060126156 | A | 12/2006 |
| KR | 100845860 | B1 | 7/2008 |
| KR | 20090132283 | A | 12/2009 |
| KR | 20100123089 | A | 11/2010 |
| KR | 20110037609 | A | 4/2011 |
| RU | 2365832 | | 8/2009 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |
| WO | 2009/110678 | A1 | 9/2009 |
| WO | 2012023717 | A2 | 2/2012 |
| WO | 2012025369 | | 3/2012 |
| WO | 2017039334 | A2 | 3/2017 |
| WO | 2018/134975 | A1 | 7/2018 |

(56) References Cited

FOREIGN PATENT DOCUMENTS

OTHER PUBLICATIONS

"Manufacturing Processes—Explosive Sheetmetal Forming," Engineer's Handbook, 2006, web archive, last accessed Jan. 19, 2016, at http://www.engineershandbook.com/MfgMethods/exforming.htm, pp. 1-3.
"Nickel Alloys for Electronics," A Nickel Development Institute Reference Book, 1988, 131 pages, Series N 11 002, NiDI Nickel Development Institute.
Daehn, "High-Velocity Metal Forming," ASM Handbook, 2006, pp. 405-418, vol. 148, ASM International.
Daehn, et al., "Hyperplacstic Forming: Process Potential and Factors Affecting Formability," MRS Proceedings, 1999, at p. 147, vol. 601.
Jimbert et al., "Flanging and Hemming of Auto Body Panels using the Electro Magnetic Forming technology," 3rd International Conference on High Speed Forming, 2008, pp. 163-172.
Shang et al., "Electromagnetically assisted sheet metal stamping," Journal of Materials Processing Technology, 2010, pp. 868-874, 211.

* cited by examiner

ICE MAKER DOWNSPOUT

BACKGROUND

Ice-making assemblies are commonly disposed within refrigerated appliances. It is therefore desirable to develop ice-making appliances and assemblies that improve the use of water during the ice-making process.

SUMMARY

In at least one aspect, a downspout for delivering water to an ice tray in a refrigerated appliance includes a cavity defined by at least one flute and at least one lobe. The downspout also includes an inlet port for receiving water. The at least one flute and at least one lobe are configured to create a substantially laminar flow of the water received from the inlet port along the at least one flute and the at least one lobe.

In at least another aspect, a water delivery system for an ice tray of a refrigerated appliance includes a downspout. The downspout includes a cavity defined by one or more elongated protuberances and one or more elongated grooves. The downspout includes an inlet port and an outlet positionable above the ice tray. A water delivery member is coupled to the inlet port of the downspout.

In at least another aspect, a water delivery system for a refrigerated appliance includes an elongated downspout, a fill line, and an inlet segment. The elongated downspout includes a hollowed-out portion defined by one or more lobes and one or more flutes arranged in an alternating lobe and flute configuration along the walls of the hallowed-out portion, wherein the one or more lobes and the one or more flutes are longitudinally disposed in the direction of the elongated downspout. The fill line includes a first end coupled to a water source and a second end coupled to the elongated downspout. The inlet segment is coupled to the downspout and the fill line. The inlet segment extends toward the first end of the fill line. The inlet segment includes multiple cross-sectional variances along a length of a channel.

These and other features, advantages, and objects of the present device will be further understood and appreciated by those skilled in the art upon studying the following specification, claims, and appended drawings.

DETAILED DESCRIPTION OF EMBODIMENTS

Figure 1:
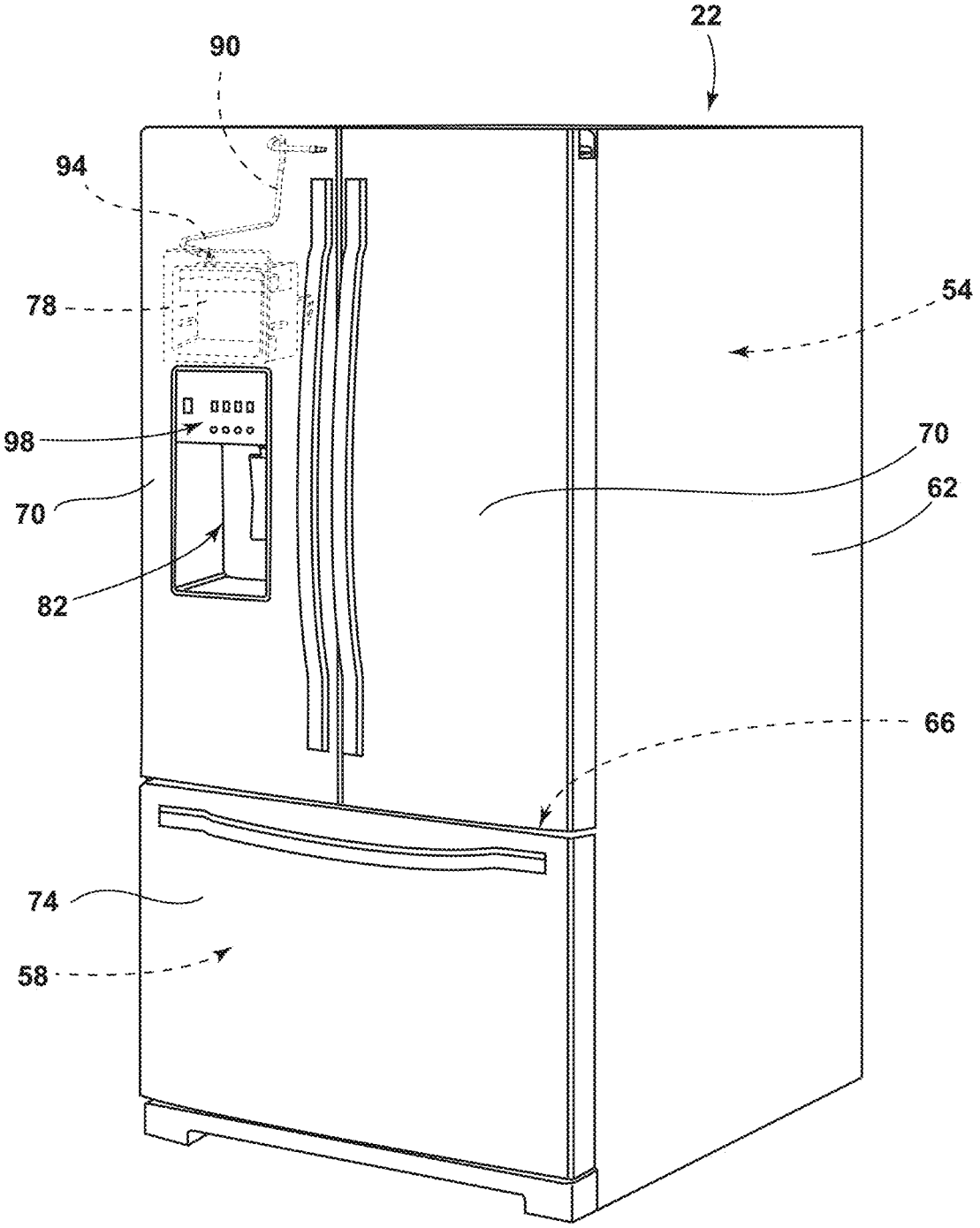
FIG. 1 is a front perspective view of a refrigerated appliance incorporating an ice maker.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIGS. 1-11, a downspout 10 for delivering water 14 to an ice tray 18 in a refrigerated appliance 22 is shown. The downspout 10 includes a downspout cavity 26. The downspout cavity 26 is defined by at least one flute 30 and at least one lobe 34. The downspout 10 for delivering water 14 to an ice tray 18 in a refrigerated appliance 22 also includes an inlet port 38. The inlet port 38 receives water 14. The at least one flute 30 and the at least one lobe 34 are configured to create a substantially laminar flow 42 of the water 14 received from the inlet port 38 along the at least one flute 30 and the at least one lobe 34.

Figure 2:
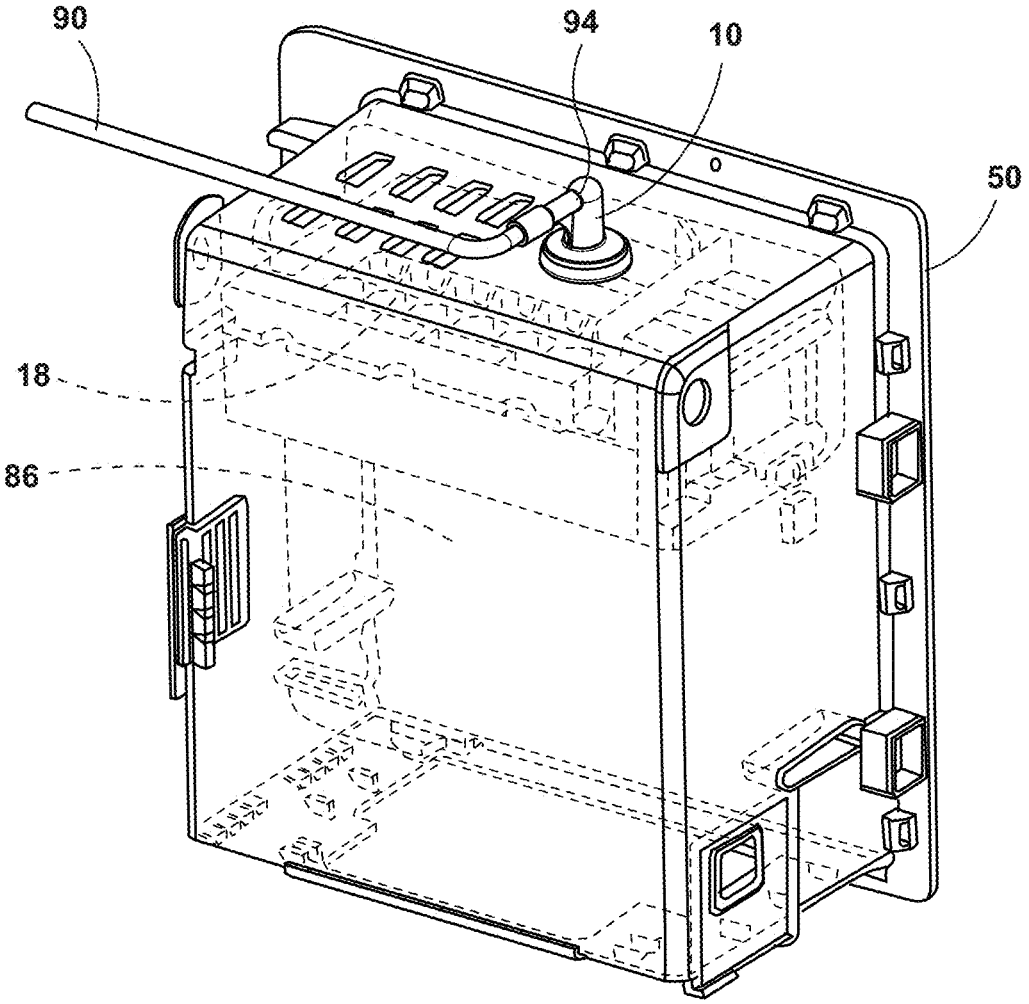
FIG. 2 is a back perspective view of an icemaker for a refrigerated appliance incorporating a fill tube and a downspout, according to an aspect of the disclosure.

Referring to FIGS. 1 and 2, reference numeral 22 generally designates the refrigerated appliance 22 with an ice maker 50. The ice maker 50 may be used as a stand-alone appliance or within another appliance, such as a refrigerator. The ice-making process may be induced, carried out, stopped, and the ice harvested with little, or no user input. FIG. 1 generally shows a refrigerator of the French-door bottom mount type, but it is understood that this disclosure could apply to any type of refrigerator, such as a side-by-side, two-door bottom mount, or a top-mount type refrigeration unit.

As shown in FIGS. 1 and 2, the refrigerated appliance 22 may have a refrigerated compartment 54 configured to refrigerate consumables and a freezer compartment 58 configured to freeze consumables during normal use. Accordingly, the refrigerated compartment 54 may be kept at a temperature above the freezing point of water and generally below a temperature of from about 35° F. to about 50° F., more typically below about 38° F. and the freezer compartment 58 may be kept at a temperature below the freezing point of water.

In some instances, the refrigerated appliance 22 has a cabinet 62 and a liner within the cabinet 62 to define the refrigerated compartment 54 and the freezer compartment 58. A mullion 66 may separate the refrigerated compartment 54 and the freezer compartment 58.

The refrigerated appliance 22 may have one or more doors 70, 74 that provide selective access to the interior volume of the refrigerated appliance 22 where consumables may be stored. As shown, the refrigerated compartment 54 doors are designated 70, and the freezer door is designated 74. It is appreciated that the refrigerated compartment 54 may only have one door 70.

The icemaker 50 may be positioned within or near the door 70 and in an icemaker receiving space 78 of the appliance to allow for delivery of ice through the door 70 in a dispensing area 82 on the exterior of the appliance. The dispensing area 82 may be at a location on the exterior of the door 70 below the level of an ice storage bin 86 to allow gravity to force the ice down an ice dispensing chute in the refrigerated appliance door 70. The chute may extend from the storage bin 86 to the dispensing area 82 and ice may be pushed into the chute using an electrically power-driven auger.

Figure 3:
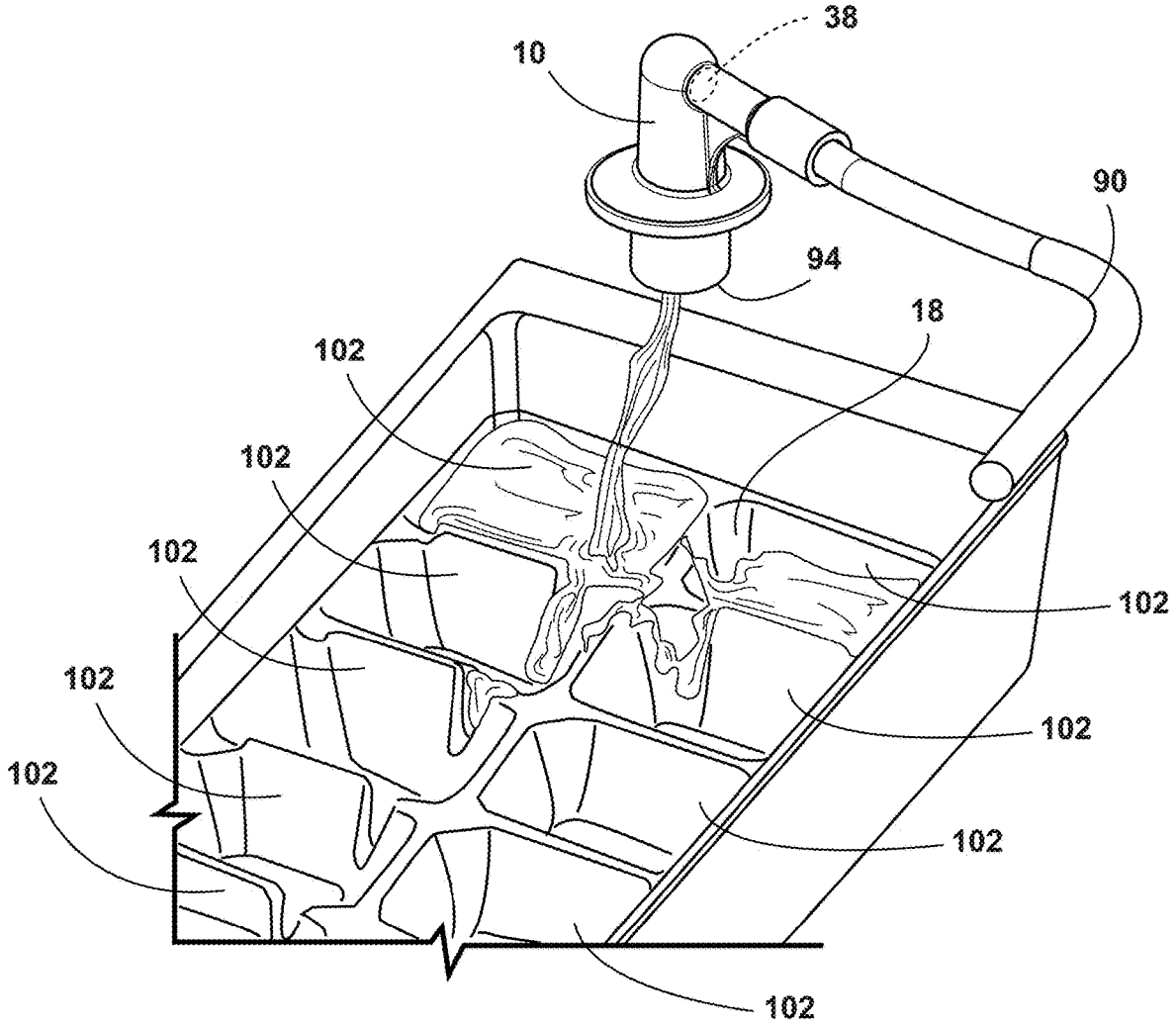
FIG. 3 is a perspective view of a fill tube with downspout disposed above an ice tray and water entering the ice tray from the downspout, according to an aspect of the disclosure.

With reference to FIGS. 1-3, the refrigerated appliance 22 may also have a water inlet that is fastened to and in fluid communication with a household supply of potable water. The water inlet may be fluidly engaged with one or more of a water filter, a water reservoir, and a water delivery member 90. The water delivery member 90 may include outlet 94 for dispensing water 14 into a downspout 10 that may be positionable above an ice tray 18. The refrigerated appliance 22 may also have a control board or controller that sends electrical signals to the one or more valves when prompted by a user through a user interface 98, which may be on the front face of a door, that water is desired or if an ice-making cycle is to begin.

With further reference to FIGS. 1-3, the icemaker 50 may be located at an upper portion of the icemaker receiving space 78. The ice storage bin 86 may be located below the icemaker 50 such that as ice is harvested, the icemaker uses gravity to transfer the ice from the icemaker to the ice storage bin 86. The ice tray 18 may include one or more ice cavities 102.

Within conventional appliances, during the ice cavity filling process, turbulent flow of water from a water delivery member or other water source that may include a downspout or a spigot may create a chaotic water surface in the cavities and/or splashing of water outside of the ice tray and into other areas of the ice maker. Water may land on other areas of the ice maker and water may freeze and prohibit other ice maker areas (for example, a motor for twisting or inverting an ice tray to release ice and/or an ice maker bail arm) from working properly. In some situations, turbulent flow of water from a water delivery member or other water source may cause a water spray in the ice maker. The water spray may cause poor ice quality and build up of ice on the ice maker motor and bail arm. Additionally, in some situations, incoming water from a water delivery member may be directed into a downspout in a manner that causes a chaotic flow of water out of the downspout. Thus, it is desirable to have a substantially laminar flow 42 of water 14 from a downspout outlet 94 or other water exit area into an ice tray 18.

With reference to FIG. 3, a perspective view of a downspout 10 and water delivery member 90 that may be configured to achieve a substantially laminar flow 42 of water 14 from the inlet port 38, through the outlet 94, and to the ice tray cavities 102 is shown.

Figure 4:
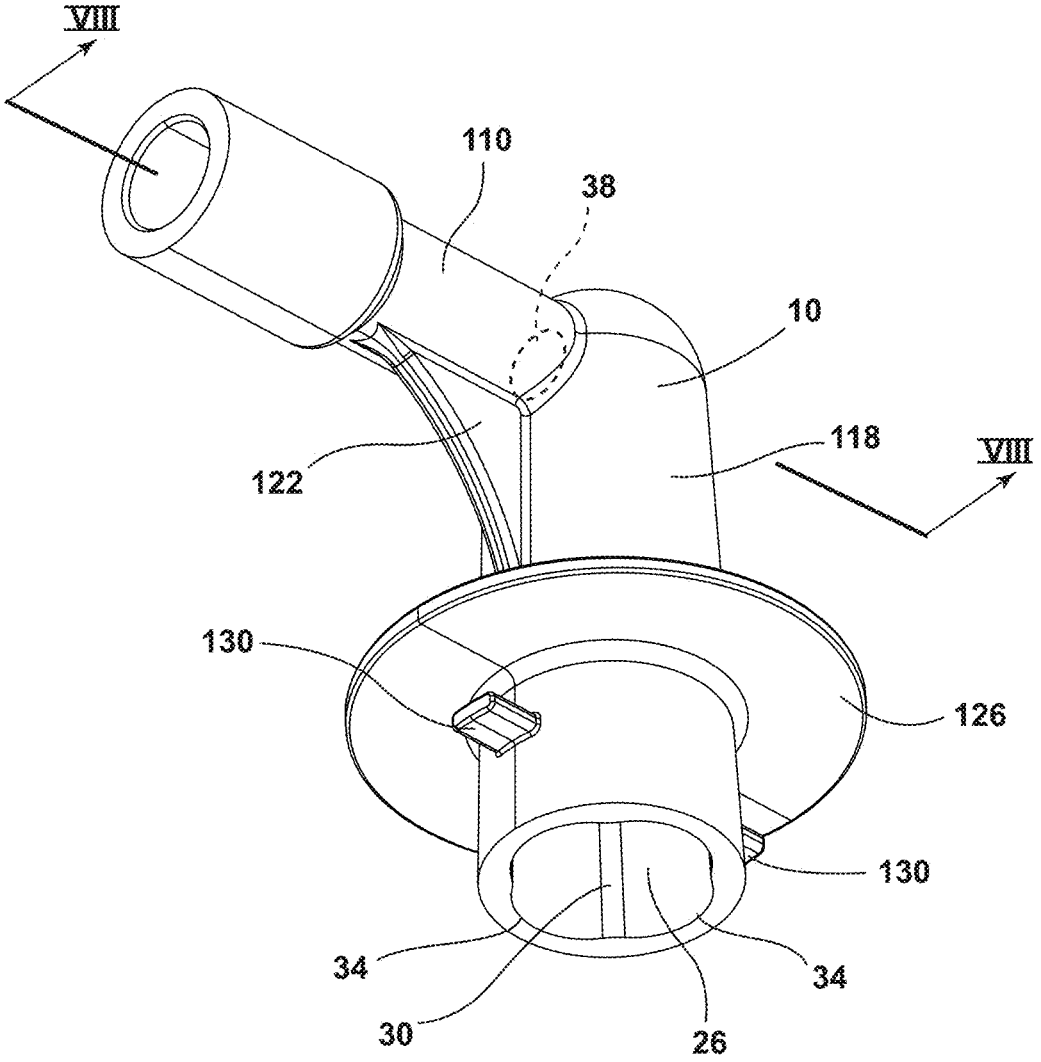
FIG. 4 is a perspective view of the downspout with an inlet segment, according to an aspect of the disclosure.

With reference to FIG. 4, a perspective view of the downspout 10 and inlet segment 110 is shown. The downspout 10 and inlet segment 110 may be configured facilitate a substantially laminar flow 42 of water 14 through the inlet segment 110 and the downspout 10 and into the ice cavities 102. The geometry of the downspout 10 and the inlet segment 110 may be configured to facilitate substantially laminar flow 42 of the water 14 within the downspout 10 and as an exit stream C (FIG. 5) that leaves the downspout 10 and travels into the ice cavities 102 of the ice tray 18. The downspout 10 may include a downspout cavity 26 having at least one flute 30 and at least one lobe 34. An inlet port 38 for receiving water 14 may be disposed in the downspout 10. The at least one flute 30 and the at least one lobe 34 may be configured to create a substantially laminar flow 42 of water 14 within the cavity. The downspout 10 may have a frustoconical shape 118. A flange 122 may extend from the inlet segment 110 to the downspout, and the flange 122 may support the downspout 10 and the inlet segment 110. A circular collar 126 may be disposed around the downspout 10 to assist in positioning the downspout 10 above the icemaker 50 and/or ice tray 18. A pair of opposing tabs 130 may extend from the downspout 10. The pair of opposing tabs 130 may assist in positioning the downspout 10 above the icemaker 50 and/or the ice tray 18. As such, the downspout 10 includes features that may improve use of the downspout 10 within an icemaker 50.

Figure 5:
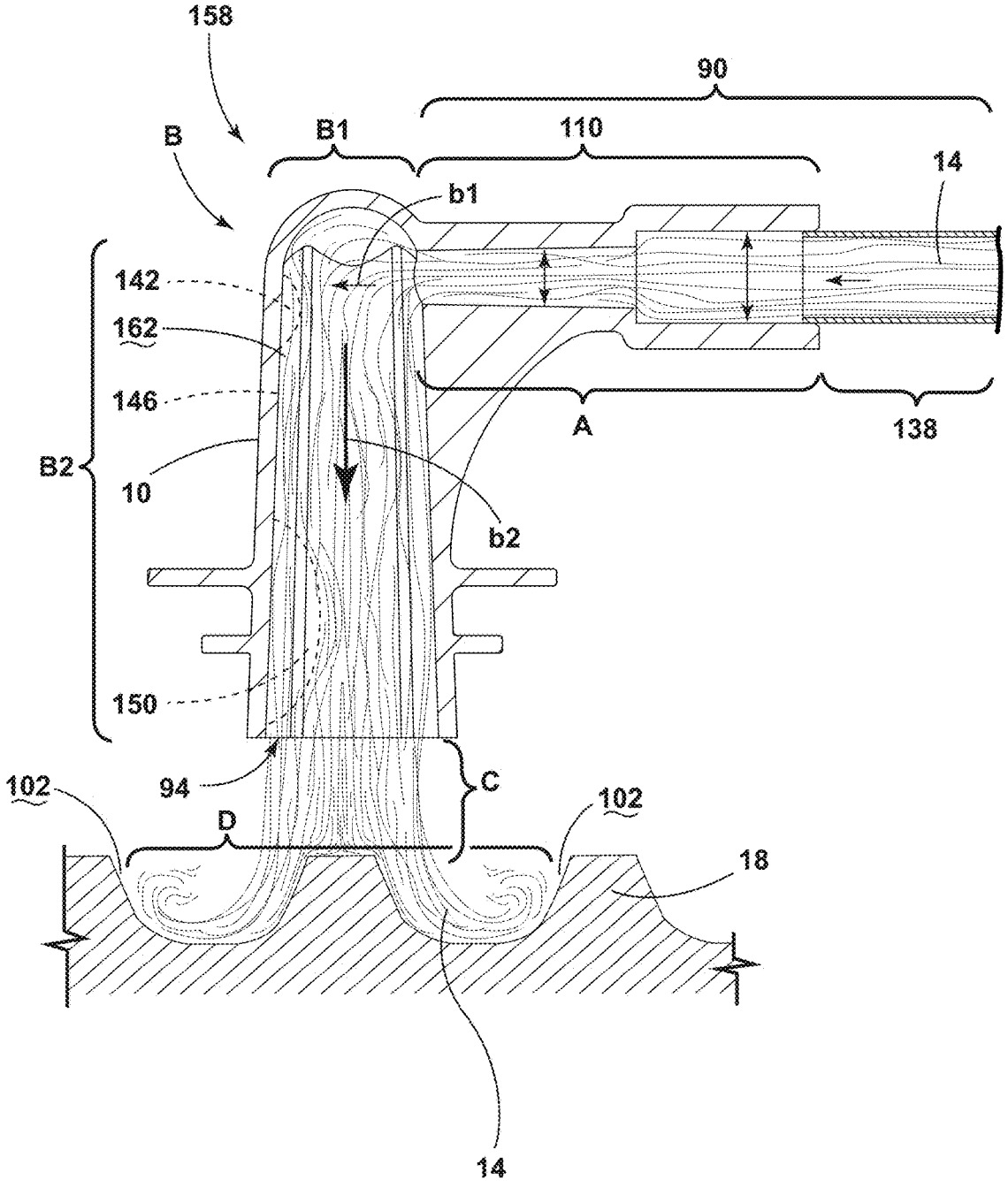
FIG. 5 is a schematic view of an inlet stream, a downspout stream, an exit stream and a fill stream of water flowing through a downspout with inlet segment and flowing into ice tray cavities, according to an aspect of the disclosure.

With reference to FIG. 5, water 14 traveling through the downspout 10 and the inlet segment 110 is shown. In the depicted aspect, the downspout 10 and the inlet segment 110 are a single part. A water fill line 138 may be coupled to the inlet segment 110. In the depicted aspect, the water delivery member 90 includes the fill line 138 and the inlet segment 110. The water 14 flowing through the inlet segment 110 and the downspout 10 and into the ice cavities 102 may be described as including several portions. The portions may include an inlet stream A, a downspout stream B, an exit stream C, and a fill stream D. The inlet stream A refers to the water stream in the inlet segment 110 prior to entry into the inlet port 38 of the downspout 10. The downspout stream B includes the stream within the downspout 10. The downspout stream B may be divided into a first downspout stream portion and a second downspout stream portion. The first downspout stream portion may include a lateral downspout stream $B_1$ that refers to water flow between the inlet port 38 and a first contact area 142 on the opposing surface 146 of the downspout cavity 26. The second downspout stream may include a longitudinal downspout stream $B_2$ that may flow from the first contact area 142 to at least a second contact area 150 disposed proximate the outlet 94 of the downspout 10. The exit stream C may refer to water 14 flowing from the outlet 94 of the downspout 10 to an ice tray 18 or water 14 in an ice tray 18. The fill stream D refers to water 14 that may have contacted the ice tray 18 or water 14 within the ice tray 18. To achieve non-turbulent and substantially laminar flow 42 of water 14 in one or more of an inlet stream A, a downspout stream B, an exit stream C, and a fill stream D, the downspout 10 and the inlet segment 110 may include specific geometries. A substantially laminar flow 42 may include a smooth flow that causes minimal splash or spray by the exit stream C as the exit stream C leaves the outlet 94 of the downspout 10 and enters the ice tray 18.

With continuing reference to FIG. 5, the flow of water 14 through the inlet segment 110 and the downspout 10 may be more particularly described. A water delivery system 158 for a refrigerated appliance 22 may include the inlet segment 110 that is positionable to deliver an inlet stream A through the inlet port 38 and a lateral downspout stream $B_1$ into the downspout cavity 26 in a lateral direction as shown by arrow $b_1$. The lateral downspout stream $B_1$ may travel from the inlet port 38 towards a first contact area 142 disposed on a surface of the downspout cavity 26. A longitudinal downspout stream $B_2$ may travel in the direction shown by arrow $b_2$. A second contact area 150 may be disposed on a surface of the downspout cavity 26 and between the first contact area 142 and the outlet 94. The second contact area 150 may be disposed over at least part of one or more lobes 34 (also referred to as elongated grooves) and the one or more flutes 30 (also referred to as elongated protuberances). The second contact area 150 is configured to facilitate substantially laminar flow 42 of water 14 between the first contact area 142 and the outlet 94. The inlet segment 110 may be transverse to the downspout 10 to direct the inlet stream A into the downspout cavity 26 (also referred to as hollowed-out portion) as the lateral downspout stream $B_1$ in a direction transverse to a cavity surface 162 that opposes the inlet port 38. As such, the design of the downspout is such that a downspout stream B of water 14 may flow in a smooth, substantially laminar and non-turbulent manner within the downspout cavity 26 and as part of the exit stream C that leaves the downspout. The exit stream C may contact the ice tray 18, and the fill stream D may flow smoothly and may have minimal splash as it enters the ice cavities 102. Further, the fill stream D may create a non-chaotic water surface in the ice cavities 102.

Figure 6:
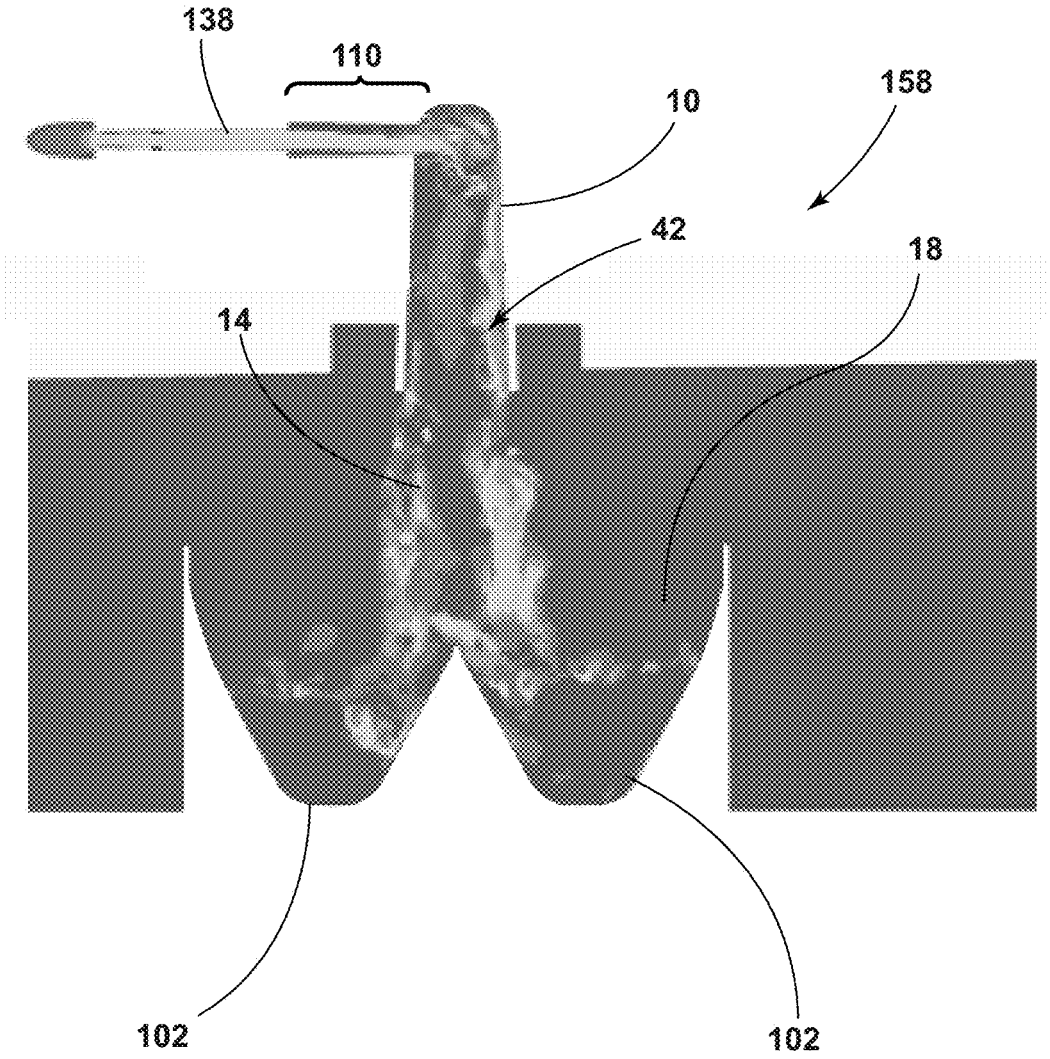
FIG. 6 is a schematic cross-sectional view of a fill line, downspout, ice tray cavities, and water entering into the ice tray from the downspout, according to an aspect of the disclosure.

FIG. 6 shows a simulation of water 14 traveling through the water delivery system 158. The water 14 may travel through a fill line 138, an inlet segment 110, and a downspout 10. The water 14 may enter the ice cavities 102 of an ice tray 18 with a substantially laminar flow 42.

Figure 7:
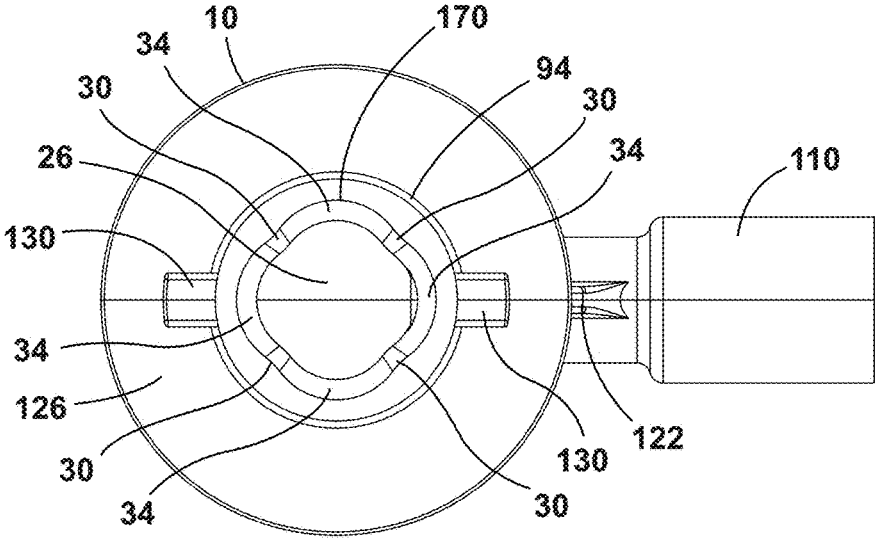
FIG. 7 is a bottom plan view of the downspout with an inlet segment of FIG. 4, according to an aspect of the disclosure.

With reference to FIG. 7, the configuration of the downspout cavity 26 may facilitate substantially laminar flow 42 of water 14 within the downspout cavity 26 and into the ice tray 18. The downspout cavity 26 may be defined by four flutes 30 and four lobes 34 that define a generally quatrefoil shape 170 of the downspout cavity 26. The outer surface 174 of the downspout 10 defines a generally frustoconical shape 118. As previously described, the collar 126 and the tabs 130 extend from the downspout 10. Additionally, the inlet segment 110 extends outward from the downspout 10. The flange 122 may connect the downspout 10 and the inlet segment 110.

Figure 7A:
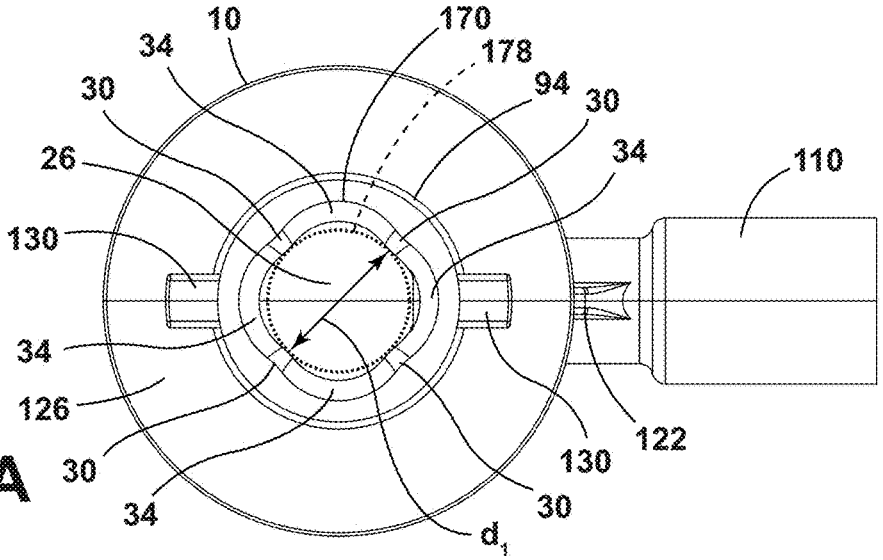
FIG. 7A is a bottom plan view of the downspout with an inlet segment of FIG. 4 showing a distance between opposing flutes, according to an aspect of the disclosure.

With reference to FIG. 7A, a first circle 178 has been superimposed on the downspout outlet 94 to show a distance between opposing flutes 30. The distance between opposing flutes 30 is the diameter $d_1$ of the first circle 178.

Figure 7B:
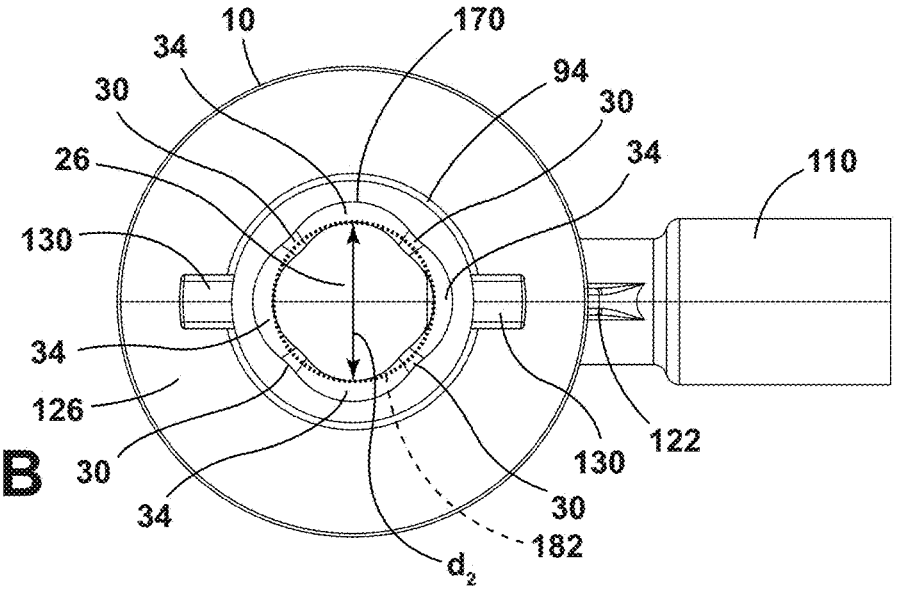
FIG. 7B is a bottom plan view of the downspout with an inlet segment of FIG. 4 showing a distance between opposing lobes, according to an aspect of the disclosure.

With reference to FIG. 7B, a second circle 182 has been superimposed on the downspout outlet 94 to show a distance between opposing lobes 34. The distance between opposing lobes 34 is the diameter $d_2$ of the second circle 182. In the aspect shown, the diameter $d_2$ of the second circle 182 is greater than the diameter $d_1$ of the first circle 178.

Figure 8:
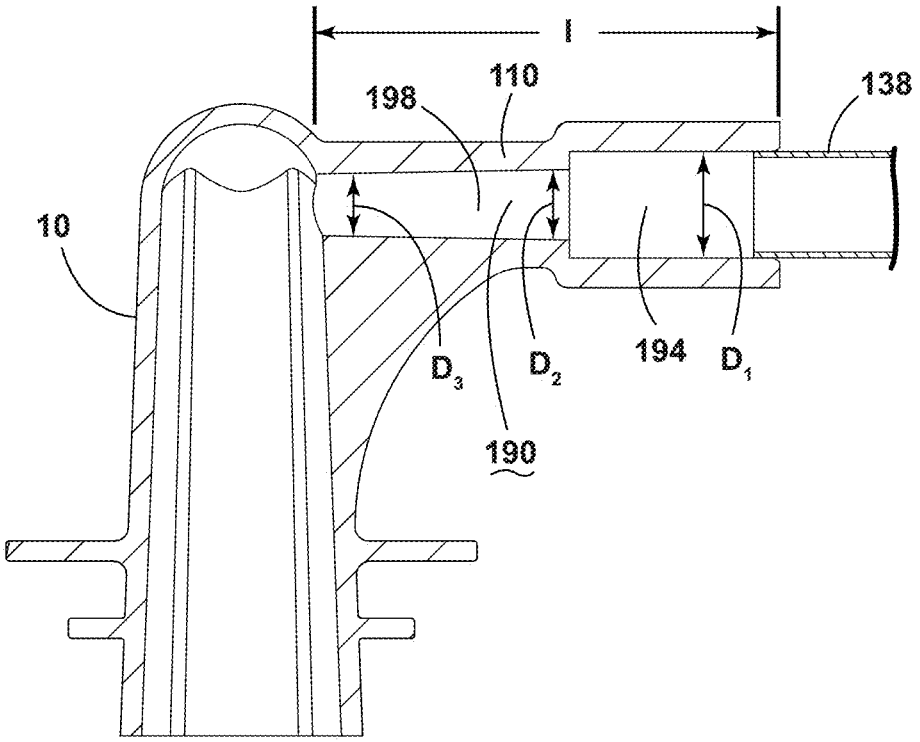
FIG. 8 is a cross-sectional view of the downspout with an inlet segment of FIG. 4 taken along line VIII-VIII, according to an aspect of the disclosure.

With reference to FIG. 8, a cross-sectional view of the downspout 10 and the inlet segment 110, as shown in FIG. 8, is shown to illustrate additional features. The channel 190 is shown with a first channel portion 194 and a second channel portion 198. In the aspect shown, the first channel portion 194 and the second channel portion 198 may have generally circular cross-sections. The first channel portion 194 may include a first diameter $D_1$. The second channel portion 198 is shown tapering between the first channel portion 194 and the inlet port 38. The second channel portion 198 includes diameter $D_2$ proximate the first channel portion 194. The second channel portion 198 includes diameter $D_3$ proximate the inlet port 38. The diameter $D_2$ may be larger than a diameter $D_3$ of the second channel portion 198 proximate the inlet port 38. As such, the diameters $D_1$, $D_2$, and $D_3$ may be selected to regulate the velocity of the inlet stream A and the lateral downspout stream $B_1$. As shown, the inlet segment 110 may have multiple cross-sectional variances along a length l of the channel. In the depicted aspect, the inlet segment 110 includes at least two cross-sectional variances (for example, two or more of $D_1$, $D_2$ or $D_3$) along the length of the inlet segment 110. The inlet segment 110 may include a first interior dimension (for example, $D_1$) and a second interior dimension (for example, $D_2$ or $D_3$). The second interior dimension may be less than the first interior dimension.

With continued reference to FIG. 8, in various aspects, the first channel portion 194 may receive a fill line 138. The fill line 138 may be inserted into the first channel portion 194. The fill line 138 may have a diameter less than the first channel portion 194 diameter $D_1$. A seal may be disposed between or around the fill line 138 and the first channel portion 194.

In various aspects, the downspout 10, the inlet segment 110, and the fill line 138 may be separate parts. In various aspects, the inlet segment 110 may be part of the fill line 138. In various aspects, the inlet segment 110 may be part of the downspout 10.

In various aspects, water 14 may be pumped into the water fill line 138 or water delivery member 90 at various pressures. In some aspects, the pressures may be in the range of from approximately 10 Pounds per Square Inch (PSI) to approximately 240 PSI. Exemplary water pressures at which water 14 may be released into the fill line 138 are approximately 20 PSI, approximately 60 PSI, and approximately 120 PSI. The water fill line 138 may be designed with a selection of flow velocity in the water fill line 138 (including the inlet segment 110) that provides for a continuous stream of water 14 that forms at least an inlet stream A and a lateral downspout stream $B_1$. Water flow velocity, water pressure, and inlet segment 110 channel diameters $D_1$, $D_2$, $D_3$, and a fill line 138 diameter may be variables that contribute to the flow characteristics of at least the inlet stream A and the lateral downspout stream $B_1$. If the lateral downspout stream $B_1$ contacts the first contact area 142 (FIG. 5) in a non-chaotic manner, then it follows that the flow of a longitudinal downspout stream $B_2$, the exit stream C, and the fill stream D may also have a substantially laminar flow 42. The velocities of the inlet stream A and the lateral downspout stream $B_1$ may be variables relevant to whether the lateral downspout stream $B_1$ contacts the first contact area 142 in a chaotic or non-chaotic manner. The downspout 10 described herein provides geometries that produce a substantially laminar flow 42 of water 14 in response to a wide range of water 14 pressures.

Figure 9:
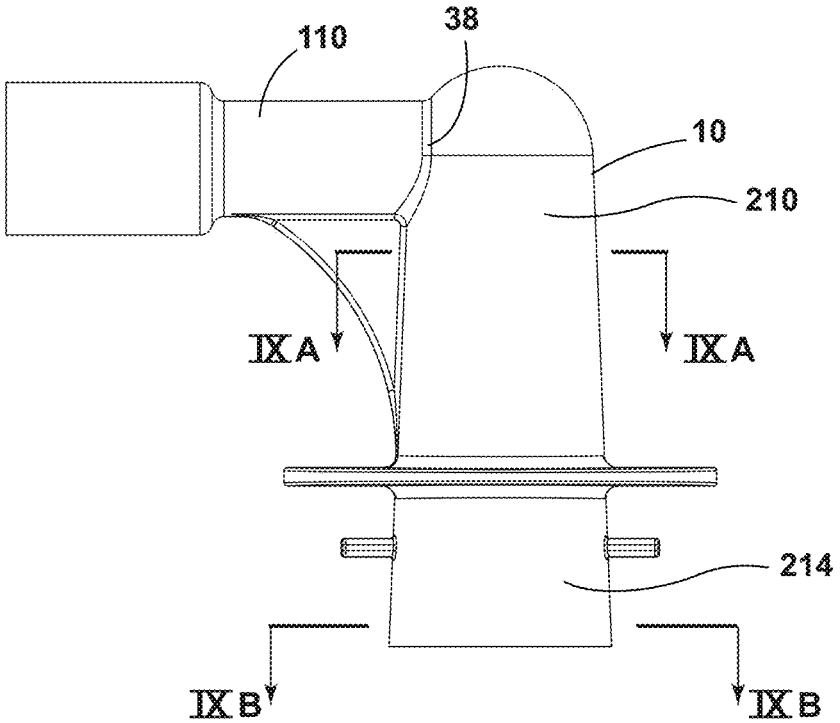
FIG. 9 is a side elevational view of the downspout with an inlet segment of FIG. 4, according to an aspect of the disclosure.
Figure 9A:
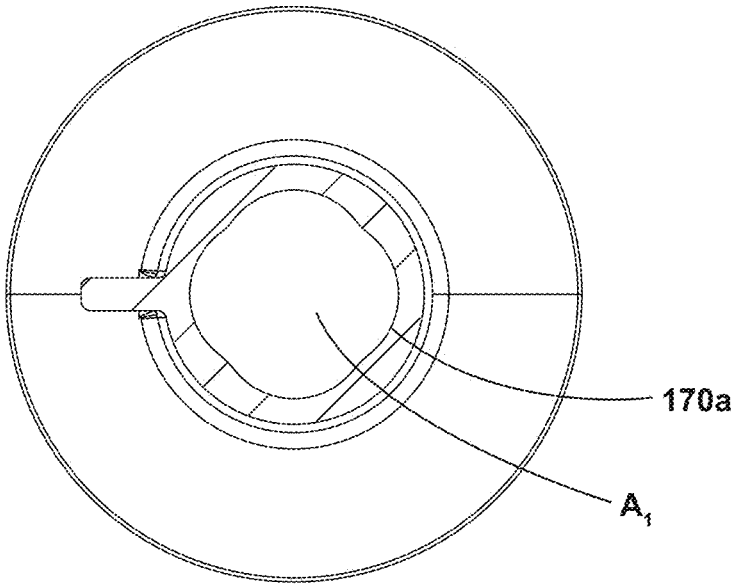
FIG. 9A is a cross-sectional view of the downspout taken along line IXA-IXA of FIG. 9, according to an aspect of the disclosure.
Figure 9B:
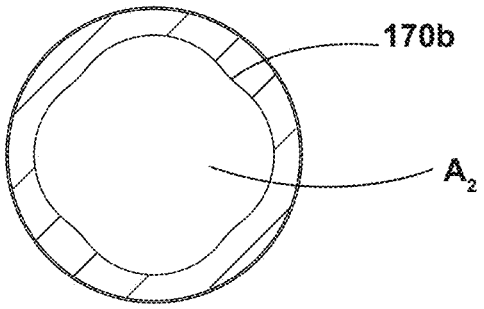
FIG. 9B is a cross-sectional view of the downspout taken along line IXB-IXB of FIG. 9, according to an aspect of the disclosure.

The downspout 10 may include additional features relevant to water flow within the downspout cavity 26. FIG. 9 shows a side view of the downspout 10 and inlet segment 110. The downspout 10 includes a water ingress portion 210 that flares outward to a water egress portion 214. The water ingress portion 210 is proximate the inlet port 38. The water egress portion 214 is proximate the outlet 94. A cross-section IXA of the downspout cavity 26 taken along the water ingress portion 210 is shown in FIG. 9A. A cross-section IXB of the downspout cavity 26 taken along the water egress portion 214 is shown in FIG. 9B. The cross-sectional area $A_1$ taken at the water ingress portion 210 is smaller than the cross-sectional area $A_2$ taken at the water egress portion 214. The first cross-sectional area $A_1$ may have a generally quatrefoil shape 170*a*. The second cross-sectional area $A_2$ may have a generally quatrefoil shape 170*b*.

Figure 10:
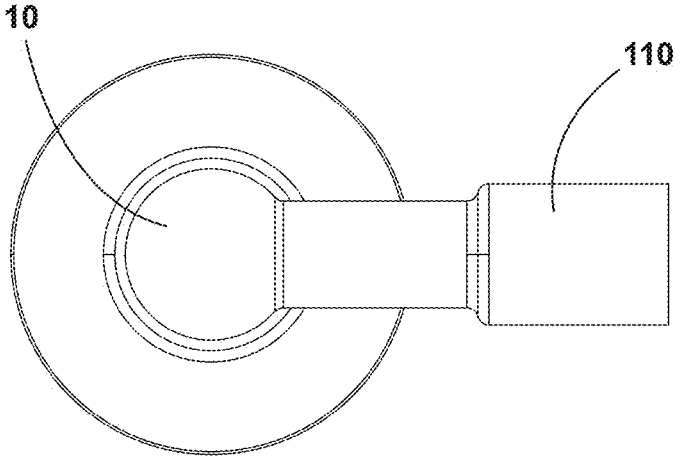
FIG. 10 is a top plan view of the downspout with an inlet segment of FIG. 4, according to an aspect of the disclosure.

With reference to FIG. 10, a top plan view of the downspout 10 and an inlet segment 110 as shown.

Figure 11:
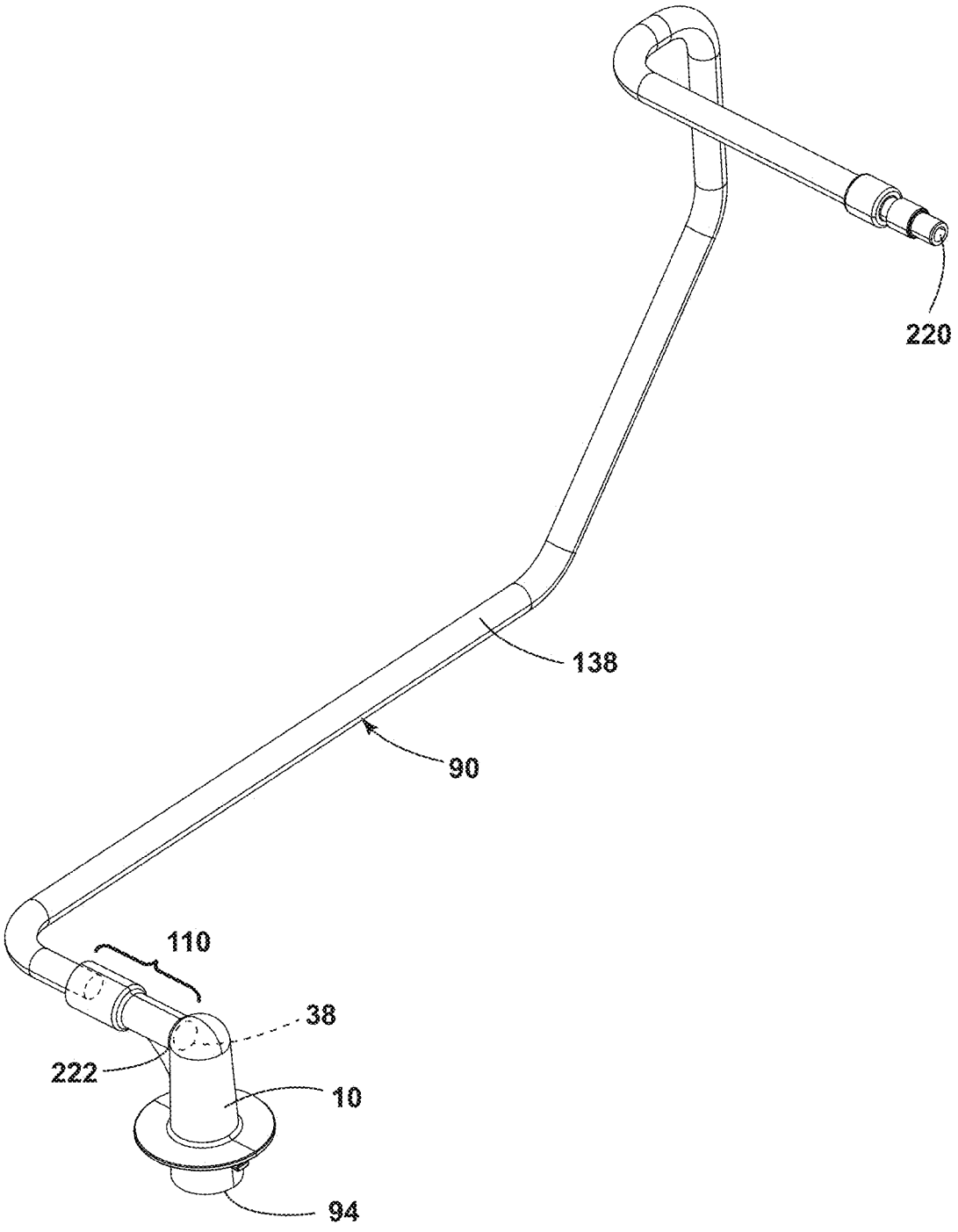
FIG. 11 is a perspective view of the downspout and a water delivery member, according to an aspect of the disclosure.

Referring to FIG. 11, the additional details of the water delivery member 90 and the downspout 10 are shown. The water delivery member 90 generally comprises a first end 220 coupled to a water source and a second end 222 coupled to the inlet port 38. As previously stated, the water delivery member 90 may include the inlet segment 110 and the fill tube 138.

A variety of advantages may be derived from use of the present disclosure. The substantially laminar flow 42 achieved by the configuration of the downspout 10 minimizes water 14 splashing within the ice maker 50 in areas other than the ice tray 18. Similarly, the configuration of the downspout 10 minimizes a chaotic water flow. Chaotic water flow may contribute to a chaotic ice surface of frozen ice cubes.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A downspout for delivering water to an ice tray in a refrigerated appliance comprising:

a cavity defined by at least one flute and at least one lobe; and an inlet port for receiving water, wherein the at least one flute and at least one lobe are configured to create a substantially laminar flow of the water received from the inlet port along the at least one flute and the at least one lobe, wherein the downspout includes a water ingress portion proximate the inlet port and a water egress portion that is configured to be positionable proximate the ice tray, wherein the cavity includes a first cross-sectional area at the water ingress portion and a second cross-sectional area at the water egress portion, wherein the first cross-sectional area is smaller than the second cross-sectional area, wherein the first cross-sectional area comprises a first generally quatrefoil shape, and wherein the second cross-sectional area comprises a second generally quatrefoil shape.

2. The downspout of claim 1, wherein the at least one flute and the at least one lobe include four flutes and four lobes, respectively, that define the first generally quatrefoil shape and the second generally quatrefoil shape of the cavity.

3. The downspout of claim 2, wherein a first distance between opposing flutes defines a first diameter, wherein a second distance between opposing lobes defines a second diameter, and wherein the second diameter is greater than the first diameter.

4. The downspout of claim 2, further comprising:

a water delivery member coupled to the inlet port, wherein the water delivery member is configured to direct a stream of water from the inlet port to a surface of the cavity.

5. The downspout of claim 4, wherein the surface of the cavity is opposed to the inlet port.

6. A water delivery system for an ice tray of a refrigerated appliance comprising:

a downspout including:

a cavity defined by:

two or more elongated protuberances arranged substantially longitudinally along the cavity; and two or more elongated grooves arranged substantially longitudinally along the cavity;

an inlet port;

an outlet positionable above the ice tray; and a water delivery member coupled to the inlet port of the downspout.

7. The water delivery system of claim 6, wherein the two or more elongated protuberances and the two or more elongated grooves include opposing elongated protuberances interspersed by opposing elongated grooves.

8. The water delivery system of claim 7, wherein the water delivery member comprises:

a first end coupled to a water source;

a second end coupled to the inlet port; and an inlet segment coupled to the inlet port and extending away from the downspout.

9. The water delivery system of claim 8, wherein the inlet segment is positionable to deliver an inlet stream and a first portion of a downspout stream through the inlet port and into the cavity in a lateral direction towards a first contact area disposed on a wall of the cavity.

10. The water delivery system of claim 9, wherein a second contact area is disposed on the wall of the cavity and between the first contact area and an outlet, wherein the second contact area is disposed over at least part of the two or more elongated protuberances and the two or more elongated grooves, and wherein the second contact area is configured to facilitate a substantially laminar flow of water between the first contact area and the outlet.

11. The water delivery system of claim 10, wherein the inlet segment is substantially transverse to the downspout.

12. A water delivery system for a refrigerated appliance, comprising:

an elongated downspout including:

a hollowed-out portion defined by one or more lobes and one or more flutes arranged in an alternating lobe and flute configuration along a surface of the hollowed-out portion, wherein the one or more lobes and the one or more flutes are longitudinally disposed in a direction of the elongated downspout, wherein the alternating lobe and flute configuration includes a first cross-sectional area having a generally quatrefoil shape and a second cross-sectional area having a generally quatrefoil shape;

a fill line including:

a first end coupled to a water source and a second end coupled to the elongated downspout; and an inlet segment coupled to the downspout and the fill line and extending toward the first end of the fill line, wherein the inlet segment includes multiple cross-sectional variances along a length of a channel.

13. The water delivery system of claim 12, wherein the inlet segment includes a first interior dimension and a second interior dimension and wherein the second interior dimension is less than the first interior dimension.

14. The water delivery system of claim 13, wherein the inlet segment and the downspout are a single part and wherein the inlet segment is positioned to direct water to a first contact area disposed on a surface of the hollowed-out portion of the downspout such that the water forms a substantially laminar flow along the one or more lobes and the one or more flutes.

15. The water delivery system of claim 12, wherein the inlet segment engages the hollowed-out portion at a lobe of the one or more lobes.

* * * * *